US007140508B2

(12) United States Patent
Kuhn et al.

(10) Patent No.: US 7,140,508 B2
(45) Date of Patent: Nov. 28, 2006

(54) SHIPPING BOX FOR SHIPPING OF HIGHLY-VALUE HIGH SENSITIVE OBJECTS

(75) Inventors: Joachim Kuhn, Wuerzburg (DE); Udo Puetz, Cologne (DE); Matthias Szarata, Bornheim (DE); Oliver Arnold, Bergheim (DE)

(73) Assignee: Hasenkamp Internationale Transporte GmbH, Frechen (DE)

( * ) Notice: Subject to any disclaimer, the term of this patent is extended or adjusted under 35 U.S.C. 154(b) by 405 days.

(21) Appl. No.: 10/670,236

(22) Filed: Sep. 26, 2003

(65) Prior Publication Data

US 2004/0124112 A1 Jul. 1, 2004

(30) Foreign Application Priority Data

Sep. 26, 2002 (DE) ..... 202 14 927
Oct. 24, 2002 (DE) ..... 202 16 474

(51) Int. Cl.
*B06D 81/38* (2006.01)

(52) U.S. Cl. ..... 220/592.26; 220/592.25; 220/592.2; 206/453

(58) Field of Classification Search ..... 206/453, 206/523, 545, 585, 591, 593; 220/592.2, 220/592.25, 592.26
See application file for complete search history.

(56) References Cited

U.S. PATENT DOCUMENTS 1,930,680 A * 10/1933 Hinton ..... 229/120
2,943,733 A * 7/1960 Poeschl et al. ..... 206/452
3,344,973 A * 10/1967 Studen ..... 206/523
3,416,692 A * 12/1968 Cline et al. ..... 220/592.25
3,525,661 A * 8/1970 Jackson ..... 428/60
3,888,557 A * 6/1975 Anderson et al. ..... 312/409
3,890,762 A * 6/1975 Ernst et al. ..... 53/440
4,953,705 A * 9/1990 Evamy ..... 206/594
5,316,171 A * 5/1994 Danner et al. ..... 220/592.21
5,441,170 A * 8/1995 Bane, III ..... 229/103.11
5,518,118 A 5/1996 Pütz et al.
5,900,299 A * 5/1999 Wynne ..... 428/69
6,464,313 B1 10/2002 Nishimoto
6,615,906 B1 * 9/2003 Fieback et al. ..... 165/10
2002/0017841 A1 2/2002 Nishimoto

FOREIGN PATENT DOCUMENTS

DE 81 10 672 U 5/1992
EP 0 636 546 A2 2/1995
EP 1 160 524 A 12/2001
EP 1 177 984 A2 2/2002

* cited by examiner

*Primary Examiner*—David T. Fidei
(74) *Attorney, Agent, or Firm*—David S. Safran

(57) ABSTRACT

A shipping box (1) for shipping of high-value, highly sensitive objects, especially framed paintings, or painting stabilized in terms of shape in some other way, has a frame having side walls (3), a bottom wall (4) and a top wall (5) which forms a cover, and can be completely sealed, the walls of the shipping box (1) being lined with vacuum insulation panels (6).

30 Claims, 5 Drawing Sheets

SHIPPING BOX FOR SHIPPING OF HIGHLY-VALUE HIGH SENSITIVE OBJECTS

BACKGROUND OF THE INVENTION

1. Field of the Invention

The invention relates to a shipping box for shipping of high-value, highly sensitive objects, especially framed paintings or paintings stabilized in terms of shape in some other way, with a frame which preferably has four side walls, a wall which forms the bottom and a wall which forms the cover, so that the shipping box can be completely sealed.

This invention is explained below using a preferred application for framed paintings. However, it should always be kept in mind that the teaching of the invention can also be used for other correspondingly high-value, highly sensitive objects, especially art objects such as wood panels, altar panels, reliefs, and optionally, also statuettes.

2. Description of Related Art

To ship paintings in frames, flat boxes made of wood are used as shipping containers; the painting in the frame is placed in the box in soft cushion material, especially in foam plastic. These boxes are then shipped vertically. The painting is tightly surrounded on all sides by cushion material in order not to be damaged when vibration and impacts occur during shipping.

Published European Patent Application EP 0 636 546 A2 and corresponding U.S. Pat. 5,518,118 describe, as a special protective measure, a combination of a special shipping holder for painting frames and a separate shipping box in which the shipping holder is installed. Such a shipping box with an inside shipping holder can then, in turn, be inserted into an outer shipping box which, for its part, is lined with shock-absorbing materials, especially foam plastic material. The present invention is intended as an improvement over this known shipping box for shipping of high-value, highly sensitive objects.

In shipping boxes of the type under consideration, the use of shock-absorbing systems of various types is known, all of which are designed to expose the highly-sensitive object to as little mechanical load as possible during shipping.

Lining the interior of a shipping boxes with an insulation material, for example, an insulation plate made of compressed wood fibers, a fiber insulation panel which also regulates the humidity within the box, is known.

One special problem in shipping boxes which have been known for decades for shipping of high-value, highly sensitive objects is heat protection, especially fire protection. For a long time, applying fire protection paint to the outside of the outer shipping box was the only approach. However, even without a fire situation, the existing shipping boxes are problematical, as before, with respect to maintaining a certain temperature in the interior where the highly-sensitive object is located. It must be considered here that these shipping boxes, when being shipped between continents, are exposed to great fluctuations in outside temperatures, for example, due to waiting times at airports, etc. To date, it has not been possible to make shipping boxes of the type under consideration such that they provide a relatively constant temperature for the highly sensitive object in the interior.

SUMMARY OF THE INVENTION

A primary object of this invention is to improve the known, initially explained shipping box such that the high-value, highly sensitive object which is to be shipped, for example, a framed painting, is protected against the action of extreme cold or heat over a considerable time interval.

This object is achieved in a shipping box by vacuum insulation panels being provided lining the inside of the shipping box.

In accordance with the invention, it is provided that the shipping box be lined inside with vacuum insulation panels; such vacuum insulation panels are known as insulation in shipping boxes for frozen, refrigerated or hot food and as insulation for heat insulation in construction. A vacuum insulation panel is a plate which has a pressure-stable core of compressed, microporous material, especially a microporous powder, which is then jacketed with a non-woven material which is used for pressure distribution, and then, is jacketed with a highly vacuum-tight, especially metal-coated, plastic film. The core of the vacuum insulation panel is evacuated to a very low residual pressure. The highly vacuum-tight plastic film, which is completely bonded, prevents repeated air entry into the core of the vacuum panel. The core itself has sufficient mechanical stability, which ensures that the shape of the plate is not changed by evacuation (see, published U.S. patent application Ser. No. 2002/0017841 A1 and the information contained therein on long-standing prior art).

Vacuum insulation panels have been known for many years, but have only been used in the aforementioned applications. Vacuum insulation panels have not been used in the area of shipping boxes for shipping of high-value, highly sensitive objects.

Vacuum insulation panels have standard thicknesses from 10 to 20 mm up to 40 mm. For this reason, they can be used to save space in generic shipping boxes. With an undamaged shell, a thermal conductivity of less than 0.005 W/mK is achieved. This is a tenth of the thermal conductivity of conventional insulation materials. Even when the highly vacuum-tight shell is damaged, the thermal conductivity, at roughly 0.02 W/mk, is still only half that of conventional insulting materials, such as foam or mineral fibers. Therefore, the interior of the shipping box in which the highly-sensitive object is located is much better protected by vacuum insulation panels against temperature changes in the environment than by conventional insulation materials.

The use of vacuum insulation panels is also especially important with respect to fire protection. The core of the vacuum insulation panels can have considerable temperature stability. The highly sensitive object located in the interior is therefore protected over a considerable time interval against the direct action of flames, even if in case of fire of course a distinct temperature increase in the interior cannot be avoided. Rescue measures for such an object can therefore be carried out before the object itself is seriously damaged.

The execution of vacuum insulation panels with a core of microporous silicic acid acquires special importance. Silicic acid powders have the same chemical structure as sand. By means of a suitable production process, extremely fine-grain powder particles with an amorphous structure can be produced. A silicic acid powder compressed into a plate with embedded fiber materials therefore has cavities in the highly porous structure which are 20 to 100 times smaller than for all other materials. Thus, the requirements for the vacuum of the vacuum insulation panel are much less than in the prior art. Even with a rough vacuum from 10 to 100 mbar, very low thermal conductivity can be achieved. The high temperature resistance of the compressed silicic acid powder is of special importance, and with temperatures of up to 1000° C., ensures serious fire protection for the highly sensitive object located in the shipping box, even if the plastic material which forms the shell has been burned up.

It is not important to the teaching of this invention whether the high-value, highly sensitive object which is to be shipped is supported directly in the shipping box, or whether there is a separate box within the shipping box for holding the object. Therefore, it can also be provided that the object is first packed into a known shipping holder or box and then is then held by the shipping box in accordance with the invention.

The invention is explained in detail below using the accompanying drawings which only show preferred embodiments.

DETAILED DESCRIPTION OF THE INVENTION

Figure 1:
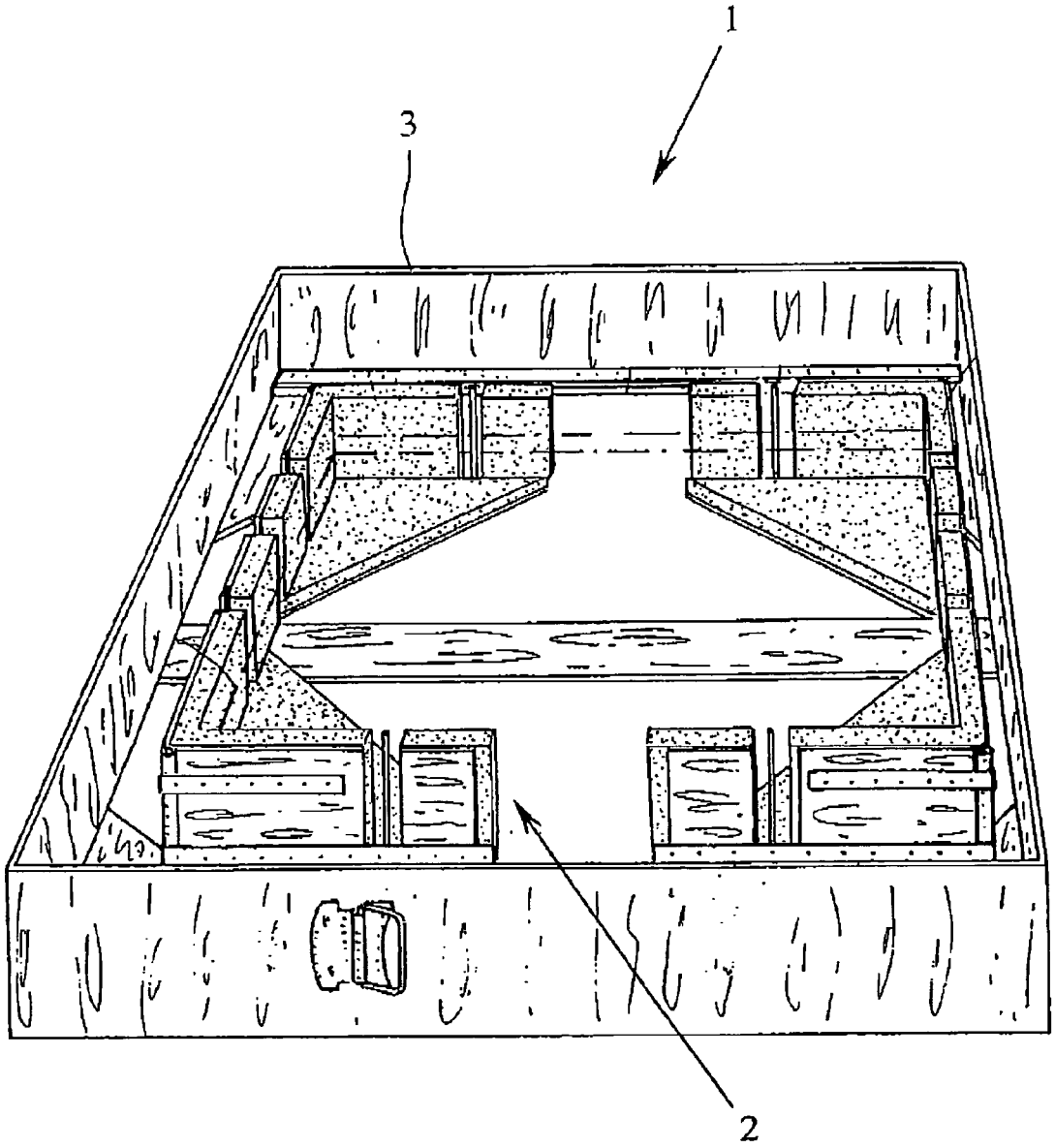
Fig. 1 (Prior Art)
FIG. 1 is a perspective view of a wooden shipping box known from the prior art with a built-in shipping holder.

FIG. 1 shows a perspective of a shipping box 1 known from the prior art with the shipping holder 2 located in it for holding a framed painting (see, U.S. Pat. No. 5,518,118). The shipping box 1 shown in FIG. 1 is composed of a frame with four side walls 3, a bottom wall 4, which is formed from one straight board and four triangular boards, and on which the shipping holder 2 is supported, and a wall which forms the cover (not shown). For reasons of saving weight, in the illustrated shipping box 1, there is not a completely closed bottom 4. Shipping boxes 1 are also known in which the bottom is formed by a completely closed bottom wall. The latter embodiment represents the starting point for this invention.

Figure 2:
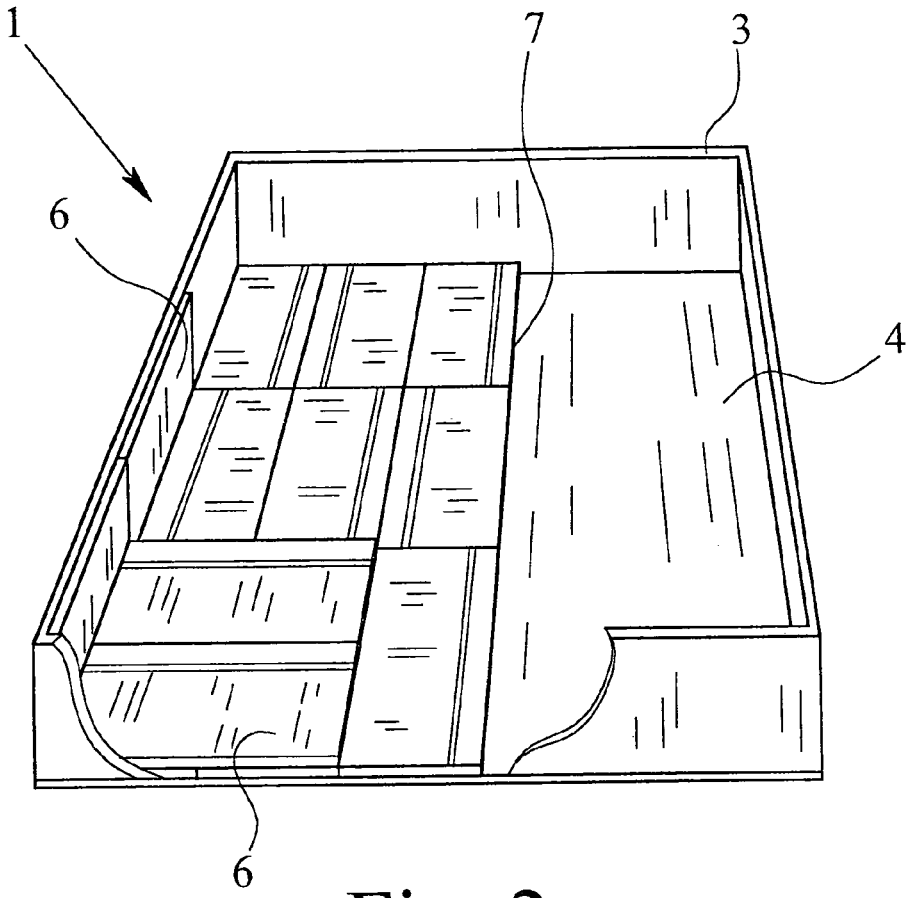
FIG. 2 is a perspective view of a shipping box partially lined with vacuum insulation panels in accordance with a preferred embodiment of the invention.
Figure 7:
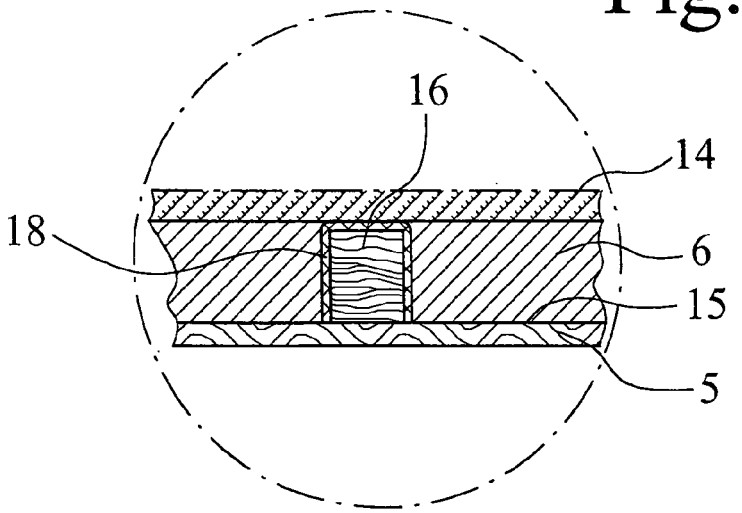
FIG. 7 is an enlarged cross-sectional view in the direction of the arrowed section line in the encircled detail of FIG. 6.

FIG. 2 is a perspective view of a preferred embodiment of the shipping box 1 in accordance with the invention. Like the shipping box known from the prior art, the shipping box 1 of the invention is composed of a frame having four walls 3, a bottom wall 4 and a top wall 5 which forms a cover (shown only in FIG. 7). Whether the frame of the shipping box 1 is ultimately formed from exactly four walls 3 or from a different number of walls 3 is not important. However, since a framed painting is generally rectangular, a frame with four walls 3 is generally used. It is essential that the shipping box can be completely closed, and therefore the walls 3, 4 are flush with one another. The shipping box 1 shown in FIG. 2 can thus be used for holding a separate shipping holder 2, a shipping box or can directly hold the object which is to be transported.

In this embodiment the shipping box 1 is partially lined on the inside with vacuum insulation panels 6. In this embodiment, the vacuum insulation panels 6 are located directly on the walls 3, 4. However, it is also possible that there are still other materials between the vacuum insulation panels 6 and the walls 3, 4, for example, insulation plates or a layer of foam plastic.

In this case, the vacuum insulation panels 6 are arranged in two layers such that the joints 7 of one layer are offset relative to the joints 7 of the bordering layer. In special cases, there can also be more than 2 layers. It is also possible to line the interior of the shipping box 1 with only a single layer of vacuum insulation panels 6. In any case, a multi-layer insulating layer with joints 7 offset relative to one another has the advantage that, on the one hand, thermal bridges are largely avoided, and on the other hand, the fire resistant behavior is distinctly improved. Several layers of vacuum insulation panels 6 can also increase the insulating safety of the shipping box 1, since, for a possible panel defect, the vacuum insulation panels 6 which lie behind or underneath still insulate.

Figure 3:
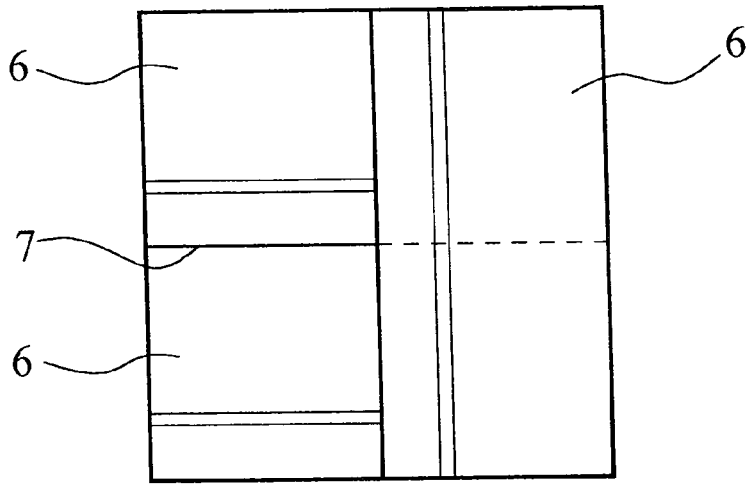
FIG. 3 is a plan view of a sample arrangement of vacuum insulation panels, FIGS. 4*a*) & 4*b*) are sectional views of two sample arrangements of vacuum insulation panels in the area of their edges in the shipping box of the invention.

FIG. 3 shows in a plan view of an example of how the vacuum insulation panels 6 can be located over one another in the shipping box 6. The upper layer of the vacuum insulation panels 6 is located turned by an angle of 90° relative to the underlying layer. It can be clearly recognized that the joint 7 between the underlying two vacuum insulation panels 6 is almost completely covered by the upper layer (broken line). However, it is also possible for the vacuum insulation panels 6 of the upper layer to be located in a parallel, but are laterally offset alignment relative to those of the bottom layer (see, FIG. 2). Other possibilities are likewise possible as long as the joints 7 of one layer are covered by the vacuum insulation panels 6 of another layer.

The aforementioned also applies to the corner edges 8 of the shipping box 1, i.e., the area in which two walls, for example, the bottom wall 4 and a side wall 3 of the frame border one another. In this area, the vacuum insulation panels 6 should also be arranged such that thermal bridges are largely avoided. Examples for optimum arrangements of vacuum insulation panels 6 in the area of the corner edges 8 are shown by FIGS. 4*a*) and 4*b*).

Figure 4:
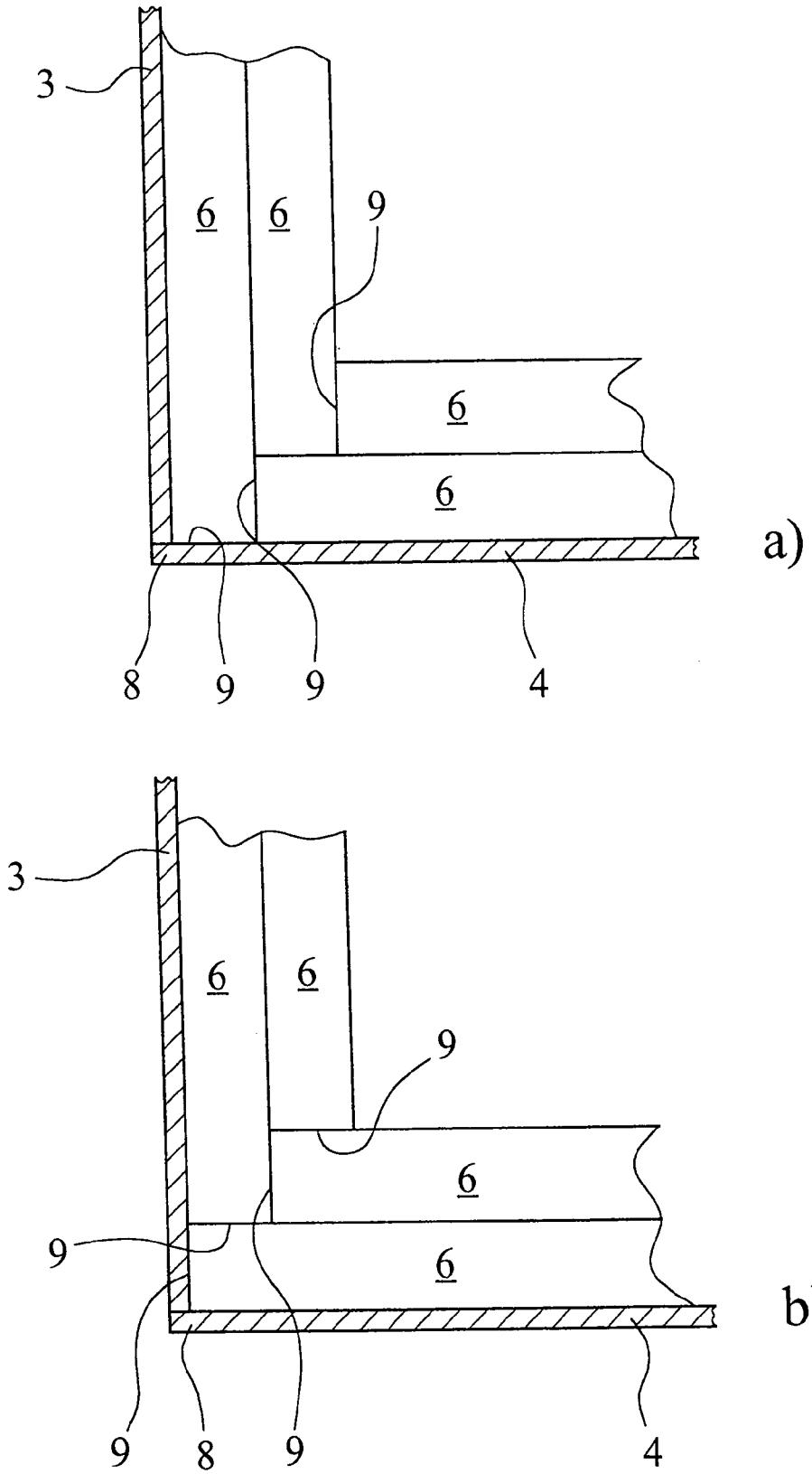

In FIG. 4*a*), the edge 8 between the walls 3 & 4 which are located at a right angle relative to one another is shown in cross section. There, first a vertical vacuum insulation panel 6 was attached to the wall 3 such that its end face 9 touches the bottom wall 4. Then, another vacuum insulation panel 6 is placed flat on the bottom wall 4 and pushed to the left until it is flush against the side surface of the vacuum insulation panel 6 which was attached first. Then, accordingly there is a second layer of vacuum insulation panels 6. Here, importance was attached to the fact that the end face 9 of the vacuum insulation panel 6 located on one wall touches the side surface of the vacuum insulation panel 6 which is located on the other wall. In this way, therefore, in the edge and corner area of the shipping box 1, thermal bridges are avoided, by which the insulation, and ultimately the fire behavior, are improved.

FIG. 4*b*) shows an alternate arrangement of the vacuum insulation panels 6 in the area of the edge 8 at the corner formed between the wall 3 and the wall 4. Accordingly, the vacuum insulation panels 6 can also be located on all other edges 8 of the shipping box 1.

In order to attach the vacuum insulation panels 6 to the walls 3, 4, 5, they are especially cemented there. Furthermore, it is also a good idea to protect the vacuum insulation panels 6 of two adjoining layers against slipping. For this purpose, the layers are advantageously joined securely to one another, especially cemented to one another. In this way, moreover, the stability of the shipping box 1 is increased.

Figure 5:
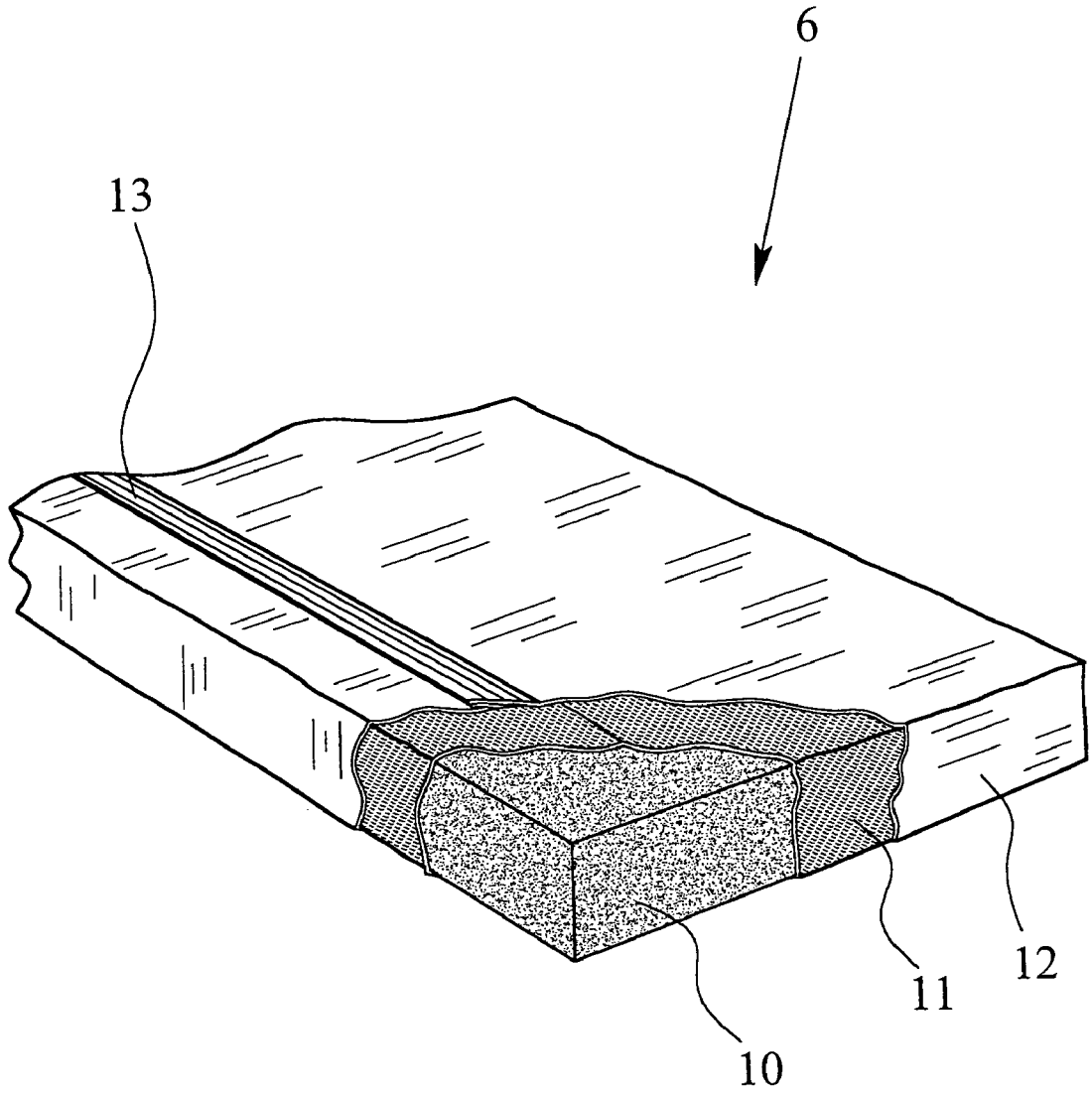
FIG. 5 shows an embodiment of a vacuum insulation panel that has been partially broken away to reveal the individual material layers.

FIG. 5 shows one embodiment of a vacuum insulation panel 6. The multilayer structure can be clearly recognized. The core 10 of the vacuum insulation panel 6 can be made of a pyrogenic and/or a microporous material, especially of a silica material (silicic acid powder, compressed). The use of this material makes it possible to evacuate the core 10 without the external loading pressure compressing the core 10. Silica material has the advantage that, by means of a special production process, extremely fine-grained powder particles with a vitreous structure are produced so that, when compressed into plates, cavities in a highly porous structure form which are 20 to 100 times smaller than in all other materials, such as, for example, organic foams. The compression of the fine-grain silica material takes place feasibly with the embedding of a fiber material of the corresponding consistency so that the overall structure is compact and cohesive. Silica material otherwise has the advantages explained in the general part of the specification with respect to temperature resistance.

If the insulating properties, but not the fire protection properties of the shipping box 1 are to be improved, vacuum insulation panels 6 with a core 10 of open-pore polyurethane or polystyrene foams or of glass fiber nonwoven material can be chosen. These vacuum insulation panels 6 also have low thermal conductivity and withstand external loading pressure.

The compressed core 10 of the vacuum insulation panel 6 shown in FIG. 5 is first covered by a nonwoven layer 11 which is then surrounded by a metal-coated plastic film 12. The plastic film is a special gas-tight film which is free of thermal bridges.

Furthermore, FIG. 5 shows a flap-shaped weld 13 which is formed as a result of production on the plastic film 12. So that the vacuum insulation panels 6 in the shipping box 1 optimally border one another, in order to achieve heat transfer as low as possible on the joints 7, the flaps or the welds 13 should not be located in the area in which the vacuum insulation panels 6 touch. Therefore, the vacuum insulation panels 6 should have a largely smooth, in any case flat, surface which shows the weld in the area of the edge. It is important that there are no projecting flaps in the area of the edge that would prevent a directly bordering arrangement of adjacent vacuum insulation panels 6.

So that, during shipping or storage, the framed painting or other high-value, highly sensitive object will be optimally protected against excess moisture within the shipping box 1, there should be a medium that absorbs moisture. This medium can be porous plates formed of, for example, compressed wood fibers—specifically so-called fiber insulating plates 14—or other bodies. When the shipping box 1 is exposed to extremely dry or hot environments for a longer time, to prevent the shipped material from drying out, there can also be a medium that will release moisture. In this way, even under changing ambient conditions, the moisture within the shipping box 1 can be kept relatively constant over a longer time.

It has already been extensively explained above that for certain highly sensitive objects it can be important to keep the temperature within the shipping box 1 as constant as possible. It is obvious that temperature constancy within the shipping box 1 depends on how much heat-storing mass is present within the shipping box 1. The heat-storing mass can be introduced by additionally present internals, additional material layers, and of course, also by the object itself which, for example, has a solid frame. However, often, the highly sensitive object is a very small object with little mass. Especially in such a case, it is recommended that a heat-storing medium be additionally deliberately provided in the interior. This is especially very effective if it is a material which acts as a latent heat reservoir, especially based on a phase change. These materials are commercially available, and they are deliberately introduced into the shipping box of the invention in order to ensure increased temperature constancy within for the highly sensitive object.

It has already been pointed out above that a box-in-box system can be used. In this case, it is recommended that at least one plate of the inner shipping box be formed by a fiber insulating plate 14.

Finally, there can also be a shock absorbing system within the shipping box that protects the object against the effects of vibrations and impacts. To do this, for example, one or more foam layers can be located within the shipping box 1. They can be provided between the walls 3, 5 and the vacuum insulation panels 6 and/or between the vacuum insulation panels 6 and the shipped material. However, the foam layers can also increase the heat insulation in addition. Ultimately, a shock absorbing system can be defined as any construction that supports the highly-sensitive object in some way such that the mechanical stresses on the object are minimized.

Figure 6:
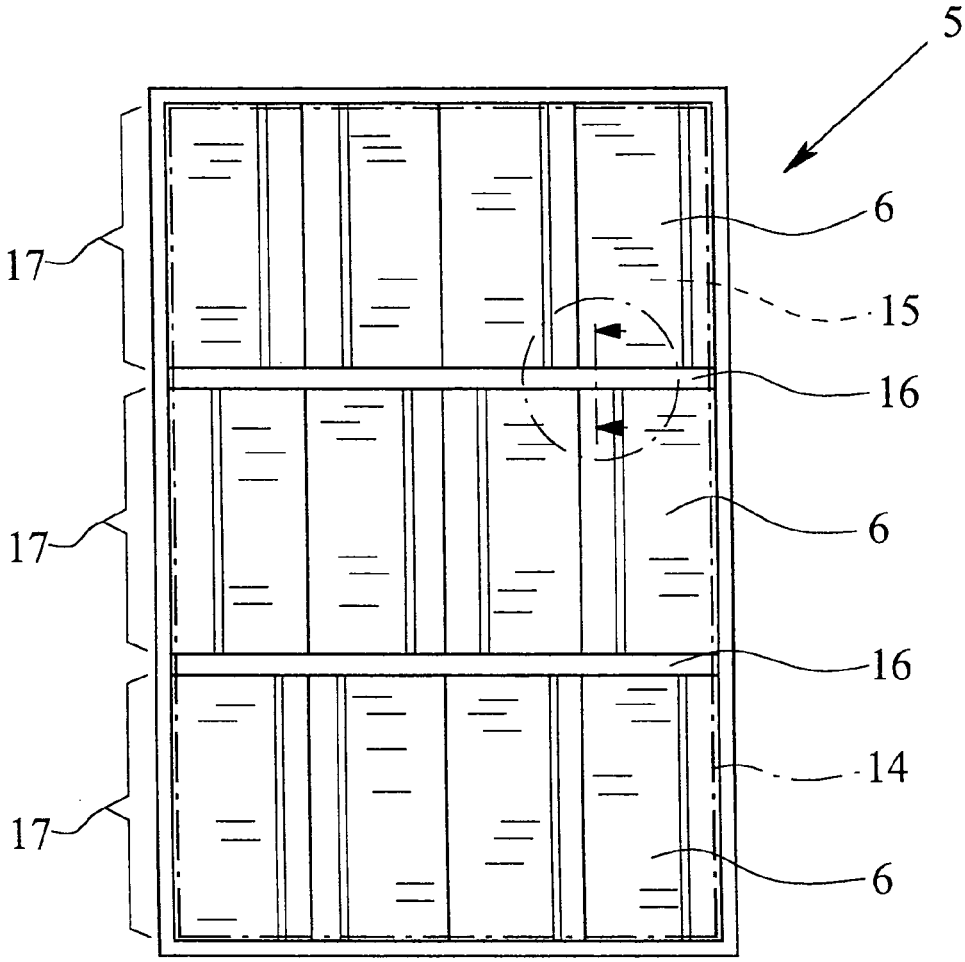
FIG. 6 shows another embodiment of the shipping box in accordance with the invention having an especially large area cover with a special structural configuration.

FIG. 6 shows a construction which is modified such that the high inherent weight of the plates of the shipping box 1 with large dimensions of several meters can be considered in structural terms. In this embodiment, it is provided that, for especially large surfaces, especially of the bottom 4 or of the cover 5 shown here, the surface 15 is divided by crosspieces 16 into several, especially three, fields 17, in which the individual vacuum insulation panels 6 are located, especially in turn cemented.

FIG. 6 shows two crosspieces 16 on the inside of the cover 5. The crosspieces 16 are lined here with insulating material 18 in order to form heat bridges that are as small as possible (extract, not to scale). In this embodiment, as shown in FIG. 6, the broken line shows that the vacuum insulation panels 6 are stabilized and fixed here in the fields 17 on the inside of the cover 5 between the crosspieces 16 by a fiber insulating plate 14 being attached here. At the same time, humidity is controlled within the shipping box 1 and the vacuum insulation panels 6 are fixed in a stable manner on the surface 15.

It is also known that tensioning belts or the like which are attached to the edges of the wall, especially of the cover 5, can be provided to fix the vacuum insulation panels 6 so that their slipping and shifting are prevented.

What is claimed is:

1. Shipping box for shipping of high-value, highly sensitive objects, comprising:

a frame having a plurality of side walls, a bottom wall and a top wall which forms a cover, the shipping box being completely enclosed by said walls, and vacuum insulation panels lining the inside of the shipping box;

wherein at least one of the bottom and the cover is divided by crosspieces into a plurality of fields in which individual vacuum insulation panels are located.

2. Shipping box as claimed in claim 1, wherein in an area at which two of walls border each other, an end face of the vacuum insulation panels located on one of the two walls touches a side surface of the vacuum insulation panels which are located on the other wall.

3. Shipping box as claimed in claim 1, wherein there are at least two layers of vacuum insulation panels and they are arranged such that joints between panels of one layer are offset relative to joints between panels of a bordering layer.

4. Shipping box as claimed in claim 3, wherein the joints between panels of said one layer run transversely to the joints of the bordering layer.

5. Shipping box as claimed in claim 1, wherein the vacuum insulation panels are joined securely to the walls.

6. Shipping box as claimed in claim 1, wherein the vacuum insulation panels are cemented to the walls.

7. Shipping box as claimed in claim 3, wherein the layers bordering one another are joined securely to one another.

8. Shipping box as claimed in claim 3, wherein the layers bordering one another are cemented to one another.

9. Shipping box as claimed in claim 1, wherein the vacuum insulation panels are free of projecting flaps and welds in edge areas thereof.

10. Shipping box as claimed in claim 1, wherein the vacuum insulation panels have a core that is made of a material that is at least one of pyrogenic and microporous.

11. Shipping box as claimed in claim 10, wherein said material is a silica material.

12. Shipping box as claimed in claim 1, wherein the vacuum insulation panels have a core that is made of open-pore polyurethane or polystyrene foam.

13. Shipping box as claimed in claim 1, wherein a medium is provided in the shipping box within an inside space surrounded by the vacuum insulation panels which is at least one of moisture absorbing and moisture releasing properties.

14. Shipping box as claimed in claim 12, wherein said medium comprises at least one fiber insulating plate.

15. Shipping box as claimed in claim 1, wherein a heat sink mass that has heat storing properties is provided in the shipping box within an inside space surrounded by the vacuum insulation panels.

16. Shipping box as claimed in claim 15, wherein the heat sink mass comprises a latent heat reservoir.

17. Shipping box as claimed in claim 1, wherein a shock absorption system is provided in the shipping box within an inside space surrounded by the vacuum insulation panels for supporting the object to be shipped.

18. Shipping box as claimed in claim 1, wherein a closable inner box for supporting the object to be shipped is provided within the shipping box.

19. Shipping box as claimed in claim 17, wherein a closable inner box for supporting the object to be shipped is provided within the shipping box.

20. Shipping box as claimed in claim 19, wherein the shock absorption system is incorporated into inner box.

21. Shipping box as claimed in claim 14, wherein a closable inner box for supporting the object to be shipped is provided within the shipping box.

22. Shipping box as claimed in claim 21, wherein the at least one fiber insulating plate forms part of the inner box.

23. Shipping box as claimed in claim 1, wherein at least one layer of foam plastic is provided between the walls of the shipping box and the vacuum insulation panels.

24. Shipping box as claimed in claim 1, wherein at least one layer of foam plastic is provided in the vacuum insulation panels.

25. Shipping box as claimed in claim 1, wherein a stabilization plate is attached to the crosspieces for additional fixation of the vacuum insulation panels.

26. Shipping box as claimed in claim 1, wherein the stabilization plate is a fiber insulating plate.

27. Shipping box as claimed in claim 1, wherein at least one layer of foam plastic is provided.

28. Shipping box as claimed in claim 1, wherein the crosspieces are lined at least on three sides with insulation material.

29. Shipping box as claimed in claim 28, wherein said insulation material is also a fire-retardant material.

30. Shipping box as claimed in claim 1, further comprising a shipping holder constructed for holding a framed picture within said shipping box.

* * * * *